US005105227A

United States Patent [19]

Kitamura et al.

[11] Patent Number: 5,105,227

[45] Date of Patent: Apr. 14, 1992

[54] METHOD AND APPARATUS FOR SUPPLYING CONTINUOUS PAPER TO A PRINTER

[75] Inventors: Goro Kitamura; Kazuyoshi Shiraishi; Ikuo Negoro; Masahiro Kita, all of Tokyo, Japan

[73] Assignee: Asahi Kogaku Kogyo Kabushiki Kaisha, Tokyo, Japan

[21] Appl. No.: 492,361

[22] Filed: Mar. 9, 1990

Related U.S. Application Data

[63] Continuation of Ser. No. 139,799, Dec. 29, 1987, abandoned.

[30] Foreign Application Priority Data

Jan. 17, 1987 [JP] Japan ..... 62-8529
Aug. 6, 1987 [JP] Japan ..... 62-196898

[51] Int. Cl.[5] ..... G03G 15/16; G03G 15/00
[52] U.S. Cl. ..... 355/274; 355/309
[58] Field of Search ..... 355/271, 274, 309; 346/160

[56] References Cited

U.S. PATENT DOCUMENTS 4,110,027 8/1978 Sato et al. ..... 355/3 TR
4,169,673 10/1979 Sato et al. ..... 355/309 X
4,260,242 4/1981 Nishikawa ..... 355/3 TR X
4,297,716 10/1981 Hirayama et al. .
4,306,800 12/1981 Kopp ..... 355/3 TR
4,354,756 10/1982 Arai .
4,377,333 3/1983 Tsuji et al. ..... 355/3 TR X
4,464,042 8/1984 Omori et al. .
4,502,776 3/1985 Matsumoto et al. .
4,513,898 4/1985 Spitsbergen ..... 226/25 X
4,547,062 10/1985 Fujiwara ..... 355/14 R
4,557,589 12/1985 Fukushi .
4,699,496 10/1987 John et al. ..... 355/3 TR

FOREIGN PATENT DOCUMENTS 2734314 2/1978 Fed. Rep. of Germany .
3210527 10/1982 Fed. Rep. of Germany .
3339952 5/1984 Fed. Rep. of Germany .
53-146637 12/1978 Japan ..... 355/14 TR
61-226766 10/1986 Japan ..... 355/4

OTHER PUBLICATIONS

"Automated Printwheel Removal Mechanism", by Okcuoglu et al., IBM Technical Disclosure Bulletin, vol. 22, No. 4, pp. 1538–1539 (Sept., 1979).

*Primary Examiner*—Joan H. Pendegrass
*Attorney, Agent, or Firm*—Sandler, Greenblum, & Bernstein

[57] ABSTRACT

A method of and an apparatus for supplying a record medium to an electrophotograph printer. The printer includes a photosensitive means on which are formed electrostatic latent images concerning with images to be printed on the basis of images data. The latent images are then converted by applying toner to the latent images to sensible images which are then transferred to the record medium at a transfer position where the sensible images are in opposition to a printable zone of the record medium to form printed images. A time from starting motion of the photosensitive means to a moment when the sensible images have arrived at the transfer position is predetermined and the record medium is supplied into the printer so that a leading end of the printable zone of the record medium arrives at the transfer position when the sensible images have arrived at the transfer position. Moreover, the record medium is supplied into the printer so that the record medium is spaced from the photosensitive means by a distance sufficient to prohibit the toner from clinging to the record medium means until the sensible images arrive at the transfer position.

20 Claims, 10 Drawing Sheets

51: AND Circuit 53,67,77: D-FF 61: First Reference Time Signal Output Circuit
71: Second Reference Time Signal Output Circuit
65,75: Reference Value Setting Circuit 63,73: Timer Standard IC

METHOD AND APPARATUS FOR SUPPLYING CONTINUOUS PAPER TO A PRINTER

This application is a continuation of application Ser. No. 07/139,799, filed Dec. 29, 1987, now abandoned.

BACKGROUND OF THE INVENTION

This invention relates to a method of supplying record mediums such as single sheets or continuous papers as rolled papers or fanfold papers on which images are formed by means of an electrophotograph output device, and more particularly to a record medium supply method for electrophotographing, which is capable of saving record medium and mitigating wear of a photosensitive member in an electrophotograph output device to contribute to prolongation of life time of the output device.

Further, this invention also relates to an apparatus for carrying out the above described method.

Printers of the electrophotography in combination of copying technique and optical techniques have various advantages such as high speed printing, high grade printed characters, low noise and the like and have been widely utilized as new information output devices.

FIG. 1 schematically illustrates an example of the arrangement of such a printer viewed in a direction in parallel with a rotating axis of a photosensitive drum used in the printer.

This printer comprises a photosensitive drum 11 rotatable in a predetermined direction, an electric charger 13 for charging the photosensitive drum, means (not shown) for generating laser beams 15 scanning a surface of the photosensitive drum 11 in the direction of its rotating axis, and a developing unit 17. These members are arranged in succession along a rotating direction of the photosensitive drum 11. The laser beams 15 are irradiated selectively on the basis of image data onto the photosensitive drum 11 charged to −400 to 500 V by the electric charger 13 to form electrostatic latent images concerning with images on the surface of the photosensitive drum. The electrostatic latent images are then made sensible by toner supplied from the developing unit 17.

On the other hand, a record medium 19 is supplied at a position which is in opposition to and spaced apart from the photosensitive drum 11 by a suitable distance downstream of the developing unit 17 in the rotating direction of the drum 11. In this embodiment, the record medium 19 is a part of a rolled paper **19*a* housed in position in the printer housing 10. The record medium 19 paid out from the rolled paper 19*a* extends about a tension roller 21 and a stationary roller 23 and passes in opposition to the photosensitive drum 11. Thereafter the record medium 19 continuously passes about a paper feeding roller 25 and between a back-up roller 27 and a heat roller 29 and arrives at a paper feeding roller 31**.

Moreover, the printer comprises a transfer charger 33 at a location where the record medium 19 is in opposition to the photosensitive drum 11 and on an opposite (rear) side of the record medium 19 facing to the photosensitive drum 11.

The sensible images which have been converted from the electrostatic latent images by the developing unit 17 are fed to the location where they are opposed to the record medium as the photosensitive drum 11 rotates. The toner on the electrostatic latent images is transferred to a transferring zone of the record medium by means of a transfer charger 33 provided on the back side of the record medium 19. In other words, the transferring position is the location where the transfer charger 33 is provided.

The zone of the record medium 19 on which the toner is transferred is then fed into a clearance between the back-up roller 27 and the heat roller 29 by means of the paper feeding rollers 25 and 31. The toner is printed to the zone of the record medium 19 by the heat roller 29 to form images on the record medium 19. Then, a new record medium is supplied from the roller paper **19*a* by means of the paper feeding roller 25 and 31**.

On the other hand, the part of the photosensitive drum which has completed the transfer of the images is brought into opposition to a cleaning unit 35 with the rotation of the photosensitive drum 11 to cause the part of the drum to be discharged and cleaned.

With the printer as above described, the above operations are cyclically effected relative to the photosensitive drum 11, and new transfer zones of the record medium 19 are successively fed from the rolled paper **19*a* so as to oppose the photosensitive drum in synchronism with the rotation of the photosensitive drum 11**.

In the method of supplying the record medium in synchronism with the rotation of the photosensitive drum according to the prior art, following problems arise with start of the printer or in forming images after the printer is kept unused for a long period of time.

In order to form electrostatic latent images concerning required images on the surface of the photosensitive drum 11 and to convert the latent images into sensible ones by toner which is then transferred to the record medium, it is needed to carry out the respective treatment, such as charging, selective light irradiation, development and transfer in succession with respect to the photosensitive drum 11 as above described. Therefore, there is no toner concerning the images at the transfer position immediately after the image formation is started. Under such a condition, if the record medium is supplied in synchronism with the rotation of the photosensitive drum, an image is not formed on part of the record medium which has been fed during moving of the first electrostatic latent images converted into visible ones to the transfer position. During such a period, the record medium is superfluously consumed.

In a printer (output device) according to the electrophotography, moreover, the part of the photosensitive drum which is charged and irradiated by light beams forms electrostatic latent images to which the toner clings in the reversal development system. In this case, at the commencement of the formation of the images, the part of the photosensitive drum 11 upstream of the electric charger 13 will be brought into opposition to the record medium without being charged. Since the toner of the developing unit 17 clings to the part of the photosensitive drum which is not charged and at zero voltage electric potential, the toner would cling to the record medium. However, the clung toner does not concern with the required images and serves only to foul the record medium which will be wasted.

In case of using a fanfold paper as the record medium, the following problem arises in addition to the above problem.

As well known, the fanfold paper is a continuous long paper formed with feeding apertures in both edges and with intermittent slit lines for folding along width directions of the paper with a predetermined interval in a longitudinal direction of the paper Instead of the paper feeding roller, by using a known tractor having pawls to be engaged with the feeding apertures of the fanfold paper, a formation of images on the fanfold paper can be effected with the printer explained in reference with FIG. 1 in the same manner as using the rolled paper. The printed fanfold paper is then separated into single sheet.

In case that such a fanfold paper is used as a record medium, the printing by a printer is usually effected on printable parts between intermittent slit lines of the fanfold paper. Therefore, the printer stops the output of data when the intermittent slit line arrives at the proximity of the transfer position until the slit line has passed the transfer position and a leading portion of a next printable part of the paper has arrived thereat. Moreover, the feeding of the fanfold paper is temporarily stopped by a mechanism (tractor) for feeding the fanfold paper, when the next printable part of the paper has arrived at the transfer position, and after a while the mechanism is again started to feed the paper when images on the photosensitive drum have arrived at the transfer position which correspond to again started output data.

Therefore, the fanfold paper is stopped while it is in contact with the rotating photosensitive drum so that a frictional force is caused between the paper and the drum and gives rise to wear of the drum.

SUMMARY OF THE INVENTION

It is a principal object of the invention to provide a method of supplying a record medium for electrophotography, which eliminates all the disadvantages of the prior art above described and which is able to save the consumption of the record medium and mitigates the wear of a photosensitive drum to improve its durability.

In order to achieve this object, in a method of supplying a record medium to a printer including a rotary photosensitive drum on which are formed electrostatic latent images concerning with images to be printed on the basis of image data, which latent images are then converted by applying toner thereto to sensible images which are then transferred to the record medium at a transfer position where the sensible images are in opposition to a printable zone of the record medium to form printed images, according to the first aspect of the invention a time from starting rotation of said photosensitive drum to a moment when said sensible images have arrived at said transfer position is predetermined, and said record medium is supplied into the printer so that a leading end of said printable zone of the record medium arrives at the transfer position when the sensible images have arrives at the transfer position.

According to the second aspect of the invention, a time from starting rotation of said photosensitive drum to a moment when said sensible images have arrived at said transfer position is predetermined, and said record medium is supplied into the printer so that the record medium is spaced from said photosensitive drum by a distance sufficient to prohibit the toner from clinging to the record medium until said sensible images arrives at the transfer position.

According to the first aspect of the invention, the feeding of the record medium is stopped until the electrostatic latent images converted into sensible ones for forming images arrives at the transfer position, thereby preventing superfluous consumption of the record medium.

According to the second aspect of the invention, unnecessary toner is prevented from clinging to the record medium so that the record medium is prevented from being fouled by the toner. Moreover, the photosensitive drum awaiting data of images is prevented from being worn off by the record medium.

It is another object of the invention to provide an apparatus for carrying out the above described method.

In order to achieve this object, in an apparatus for supplying a record medium to a printer there is included a photosensitive means; an electric charger, an electrostatic latent image forming means, a developing unit and a transfer charger which are arranged in succession along a moving direction of the photosensitive means; and a record medium supplying means for supplying the record medium between the transfer charger and the photosensitive medium. According to another aspect of the invention, the apparatus comprises a record medium supply control circuit including first and second reference time signal output circuit, the first reference time signal output circuit which initiates the count operation upon receipt of a signal for starting to move the photosensitive means and which generates a first output signal after a given time passes from the initiation of the count operation, and the second reference time signal output circuit which initiates the count operation upon receipt of the signal for starting to move the photosensitive means and which generates a second output signal after a predetermined time being longer than the given time passes from the initiation of the count operation;

said first output signal being used as a first starting signal for operating said electronic latent image forming means and said developing unit; and said second output signal being used as a second starting signal for operating said transfer charger and said record medium.

According to further aspect of the invention, said apparatus comprises a record medium supply control circuit including first and second reference time signal output circuit, the first reference time signal output circuit which initiates the count operation upon receipt of a signal for starting to move the photosensitive means and which generates a first output signal after a given time passes from the initiation of the count operation, and the second reference time signal output circuit which initiates the count operation upon receipt of the signal for starting to move the photosensitive means and which generates a second output signal after a predetermined time being longer than the given time passes from the initiation of the count operation, and record medium moving means for moving said record medium toward and away from said photosensitive means in response to the change of said second output signal.

According to further aspect of the invention, said apparatus comprises record medium moving means for moving said record medium toward and away from said photosensitive means.

The invention will be more fully understood by referring to the following detailed specification and claims taken in connection with the appended drawings.

DESCRIPTION OF THE PREFERRED EMBODIMENTS

Before explaining a first embodiment of the record medium supply method for electrophotographing (referred to sometimes as "supply method" hereinafter) according to the invention, a printer as an example of an output device for electrophotographing will be explained, which is preferable for carrying out the supply method of the first embodiment.

Figure 1:
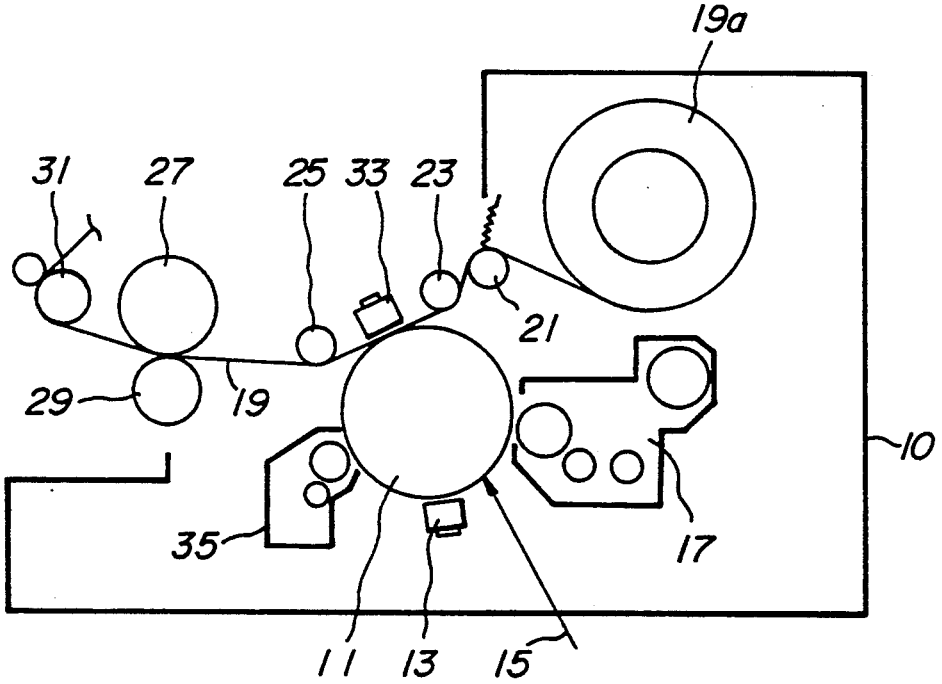
FIG. 1 PRIOR ART
FIG. 1 is a schematic view illustrating an electrophotograph output device of the prior art.

The supply method according to the invention resides in the improved timing for supplying a record medium to a photosensitive drum and the improved relative position between the record medium and the photosensitive drum to save the consumption of the record medium and mitigate the wear of the photosensitive drum. Therefore, the printer preferable for carrying out the invention can be constructed by newly adding components preferable for carrying out the supply method of the invention to the printer which has been known, as shown in FIG. 1

Figure 2A:
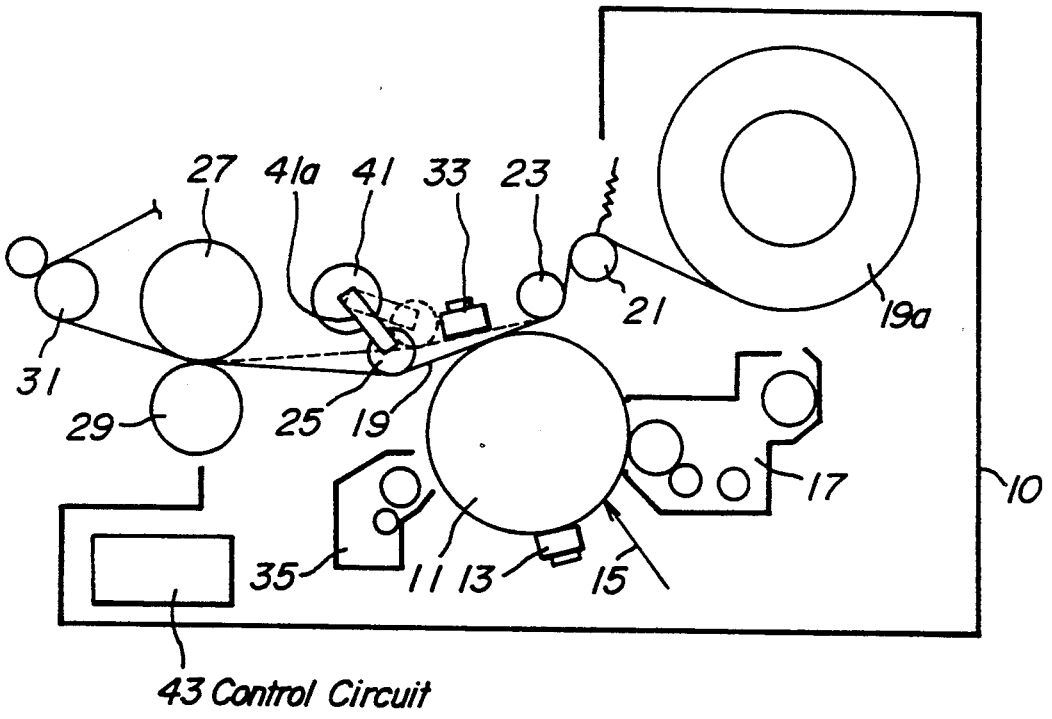
FIG. 2*a* is a schematic view illustrating an electrophotograph device suitable for carrying out a first embodiment of the electrophotograph record medium supply method according to the invention.

FIG. 2*a* illustrates a printer which has added the components required for carrying out the supply method according to the invention in which the printer is viewed a direction in parallel with a rotating axis of the photosensitive drum. Moreover, in the drawings inclusive of FIG. 2, the figures are schematically shown so long as they are sufficient to understand the invention. Therefore, sizes, shapes and positional relations are not limited to those shown in the drawings. Further, like components in the respective drawings are designated by the same reference numerals, and the components of the prior art already explained by referring to FIG. 1 will not be described.

Referring to FIG. 2*a*, a means for moving a record medium in this embodiment comprises a rotary solenoid 41 having a rotating arm 41*a* connected to a paper feeding roller 25. A reference numeral 43 denotes a record medium supply control circuit (which will be referred to sometimes as "control circuit"). When the control circuit 43 does not supply any signal to the rotary solenoid 41, the rotating arm 41*a* of the rotary solenoid 41 assumes a position shown in phantom lines in FIG. 2*a*, in which the paper feeding roller 25 is spaced from a photosensitive drum 11 by a certain distance. Since the record medium 19 abutting against the paper feeding roller 25 is subjected to a tensile force, the record medium 19, together with the roller 25, is also spaced from the photosensitive drum 11. On the other hand, when a signal is supplied from the control circuit 43 to the rotary solenoid 41, the rotating arm 41*a* rotates a predetermined angle in a clockwise direction in this case so that the paper feeding roller 25 moves a certain distance toward the photosensitive drum 11 and therefore the record medium 19 approaches the photosensitive drum 11. By suitably determining the moving distance of the paper feeding roller 25 driven by the rotary solenoid 41, the record medium 19 can be spaced from the photosensitive drum 11 so as not to permit the toner to cling to the record medium when the signal is not supplied from the control circuit 43 to the rotary solenoid 41. On the other hand, when the signal is supplied to the solenoid, the roller 25 can be held at the position which is appropriate for the toner transfer as explained with reference to FIG. 1.

Moreover, the control circuit 43 generates a signal for feeding a new record medium 19 from a rolled paper 19*a* by the paper feeding rollers 25 and 31. The control circuit 43 is further able to generate signals for controlling actuation of a developing unit 17, its bias power source and a transfer charger 33.

Figure 2B:
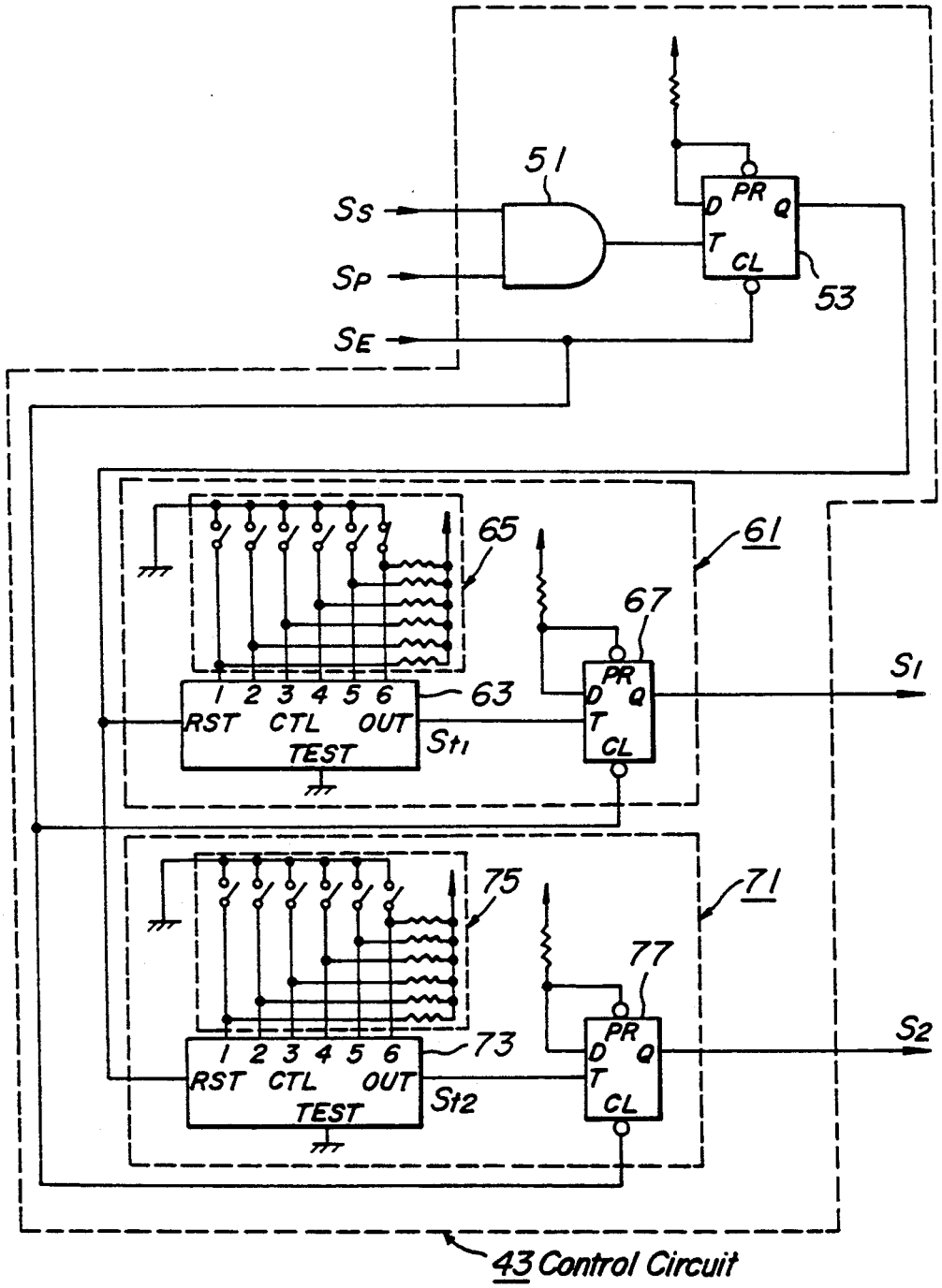
FIG. 2*b* is a view showing a control circuit for use in the electrophotograph output device shown in FIG. 2*a;*
Figure 3A:
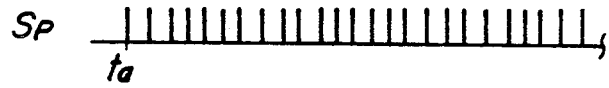
FIG. 3*a*–3*f* illustrate signal wave forms for explaining operations of shown in FIG. 2*b;*
Figure 3B:
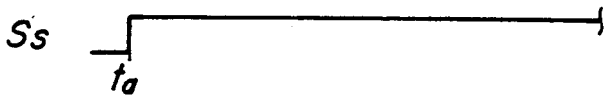
Figure 3C:
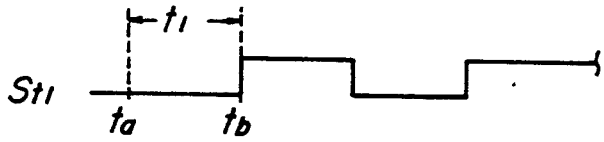
Figure 3D:
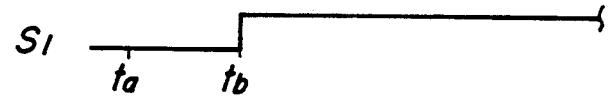
Figure 3E:
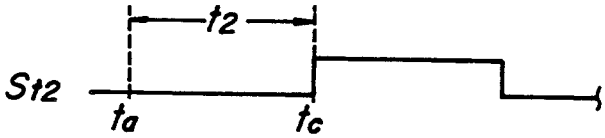
Figure 3F:
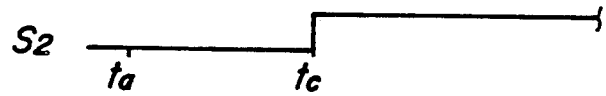
Figure 4A:
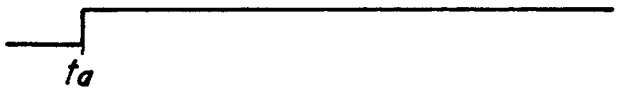
FIGS. 4*a*–4*h* are views illustrating time charts for explaining the electrophotograph record medium supply method according to the invention.
Figure 4B:
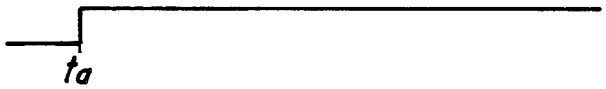
Figure 4C:
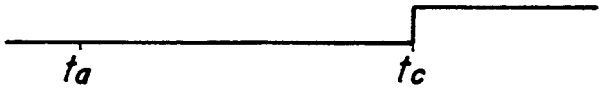
Figure 4D:
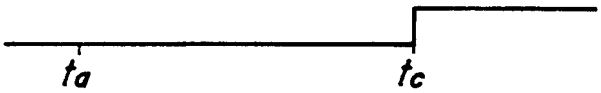
Figure 4E:
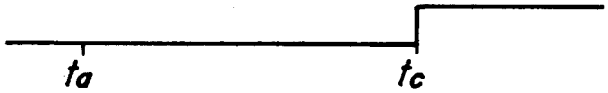
Figure 4F:
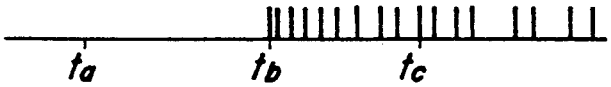
Figure 4G:
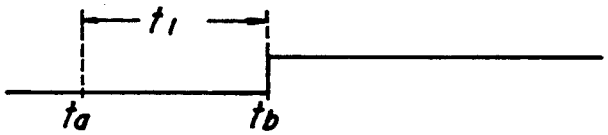
Figure 4H:
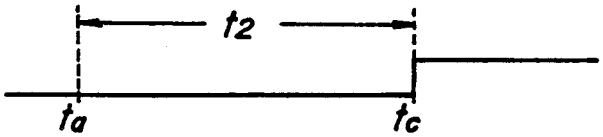

FIG. 2*b* illustrates one example of the control circuit 43 which comprises an AND gate 51, a D flip flop circuit 53 (D-FF53), and first and second reference time signal output circuits 61 and 71 constructed by similar circuits.

A signal $S_S$, for starting to rotate the photosensitive drum is inputted into one input terminal of the AND gate 51 and a signal $S_P$, for driving the photosensitive drum is inputted into the other input terminal of the AND gate 51. An output terminal of the AND gate 51 is connected to a T terminal of the D-FF 53. Voltage conditions of the D terminal and PR terminal are at high levels. Further, a signal $S_E$ for finishing the formation of images is input into a CL terminal of the D-FF 53.

In this case, moreover, the signal $S_S$ may be a signal for instructing a first formation of image after the printer is started or after the printer has been rested for a long period of time. The signal $S_E$ may be a signal for resting the printer for a long time for the purpose of power saving.

The first reference time signal output circuit (referred to sometimes as "output circuit" hereinafter) 61 will be explained. The output circuit 71 is substantially the same as the output circuit 61.

Referring to FIG. 2*b*, reference numeral 63 denotes a timer standard IC having a RST terminal which is connected a Q terminal of the D-FF 53. A reference value setting circuit 65, for setting a predetermined reference time in the timer standard IC 63 is able to input high or low signals in unit of bit into the timer standard IC 63.

The timer standard IC 63 has a clock function which starts to measure the time in response to a signal input into the RST terminal thereof from the D-FF 53 and generates a signal, for example at high level from an OUT terminal thereof, when the lapsed time after starting the measurement becomes equal to a value set by the reference value setting circuit 65. Reference numeral 67 denotes a D flip flop circuit (D-FF) having a T terminal to which is connected the OUT terminal of the timer standard IC 63. Voltage conditions of D terminal and PR terminal of the D flip flop 67 are at high levels. The D-FF 67 has a CL terminal into which a signal $S_E$, for finishing the formation of the image, can be input in the same manner as in the D-FF 53.

The second reference time signal output circuit 71 comprises a timer standard IC 73, a reference value settling circuit 75 and a D-FF 77 connected to each other in the same manner as in the first reference time signal output circuit 61.

Operation of record medium supply circuit 43

FIGS. *3a–3f* illustrate wave forms signals used in the control circuit 43. The wave form in FIG. *3a* is of the pulse $S_P$ for driving the photosensitive drum. The waveform in FIG. *3b* is of the signal $S_S$ for starting to rotate the photosensitive drum. The waveform in FIG. *3c* is of an output signal $S_{t1}$ from the OUT terminal of the timer standard IC 63. The wave form in FIG. *3d* is of an output signal $S_1$ of the first reference time signal output circuit 61. The waveform in FIG. *3e* is of output signal $S_{t2}$ from the OUT terminal of the timer standard IC 73. The waveform in FIG. *3f* is of an output signal $S_2$ from the second reference time signal output circuit 71.

The operation of the control circuit 43 will be explained by referring to FIG. *2b* and FIGS. *3a–3f*. Delay times caused in operations of the electronic elements will be neglected in the following explanation.

The signal $S_S$ for starting to rotate the photosensitive drum is at a high level when the time becomes $t_a$ (FIG. *3b*). The voltage condition at the output terminal of the AND gate 51 is at a high level depending upon AND of the signal $S_S$ at the high level and the signal $S_P$ for driving the photosensitive drum. In consequence thereof, the voltage at the Q terminal of the D-FF 53 is at a high level. In response to the high level of the Q terminal, the timer standard IC 63 and 73 start the time measurement.

It is assumed in this case that the reference value setting circuit 65 concerning the timer standard IC 63 has been set at a value corresponding to a certain period of time $t_1$ and the reference value setting circuit 75 concerning the timer standard IC 73 has been set at a value corresponding to a certain period of time $t_2$ ($t_1<t_2$).

At a time $t_b$ when time from $t_a$ to $t_1$ has lapsed, the voltage at the OUT terminal of the timer standard IC 63 is at a high level for a certain period of time (FIG. *3c*). At this moment, the voltage at the Q terminal of the D-FF 67 changes into a high level (FIG. *3d*).

Moreover, at the time $t_c$ when the time $t_2$ has lapsed from $t_a$ to $t_c$, the voltage at the OUT terminal of the timer standard IC 73 is at a high level for a certain period of time (FIG. *3e*). At this moment, the voltage at the Q terminal of the D-FF 77 changes into a high level (FIG. *3f*).

These voltages at the Q terminals of the D-FF 67 and 77 are maintained until the signal $S_E$ is input thereinto.

The control circuit 43 is connected in this embodiment with the components of the printer in the manner to accomplish the following operations. The output signal $S_1$ from the control circuit 43 serves to turn on or off a relay (not shown) of a driving motor for the developing unit 17 and a bias voltage power source (not shown) for transferring the toner from the developing unit 17 to the photosensitive drum 11. Moreover, the output signal $S_2$ from the control circuit 43 serves to control the paper feeding operations such as on and off the rotary solenoid 41, rotation and stoppage of the back up roller 27 and upward and downward movements of the heat roller 29, and on and off of a power source of the transfer charger 33.

Supply method of record medium for electrophotograph

One embodiment of the supply method according to the invention will be explained by the use of the above described printer having such a control circuit 43 and the rotary solenoid 41 connected to the paper feeding rollers.

In this embodiment, the above described first and second reference times $t_1$ and $t_2$ are set so as to fulfil the following relation. Assuming in rotating the photosensitive drum 11 that $T_1$ is a time required for the part of the photosensitive drum 11 in opposition to the electric charger 13 to be brought into opposition to the developing unit 17 and $T_2$ is a time required for the part of the photosensitive drum 11 to be further brought into opposition to the transfer charger 33 (transfer position), and there are relations of $$t_1>T_1 \text{ and } t_2>T_1+T_2.$$

Under this condition, electric power is supplied from a power source to the printer. FIGS. *4a–4h* are time charts illustrating operations of the printer for forming images after the electric power has been supplied to the printer.

At a time $t_a$ after the supply of the power, an instruction for starting the formation of the images is generated to cause the signal $S_S$ for starting the rotation of the photosensitive drum to be at a high level (FIG. *4a*), so that electric power is supplied to the electric charger 13 (FIG. *4b*) and a part of the photosensitive drum 11 in opposition to the electric charger 13 is charged.

In the control circuit 43, moreover, when the signal $S_s$ becomes a high level, the time measuring for $t_1$ and $t_2$ is started, respectively, as explained in reference with FIG. *2b*. *At a time* $t_b$ when the time $t_1$ has elapsed from the time $t_a$, the developing unit 17 is started (FIG. *4g*), while laser beams are irradiated on the charged photosensitive drum according to data for forming images (FIG. *4f*). At a time $t_c$ when the time $t_2$ has lapsed from the time $t_a$, the rotary solenoid 41, the back-up roller 27, the heat roller 29 and the transfer charger 33 are started to operate (FIGS. *4c–4e* and *4h*). After the time $t_c$, the record medium 19 is brought into opposition to the photosensitive drum 11 with a distance suitable for the toner transfer, while paper feeding is successively effected till the signal $S_E$ is input to each other of CL terminals of the D-FFs 53, 65 and 67.

In this embodiment, the heat roll 29 is lowered until the time becomes $t_c$ so as to move away from the record medium, thereby mitigating the influence of the heat from the heat roll on the record medium.

In the supply method as above described, by setting $t_1$ and $t_2$ at suitable values the record medium can be supplied such that a leading end of a printable zone of the record medium arrives at a transfer position when a first electrostatic latent image has arrived at the transfer position after starting the image formation. In this case, for example, the time $t_2$ may preferably be set as that $t_2$ defined by the following equation $$t_2=t_1+T_3+T_2,$$

where $T_3$ is a time required for the part of the photosensitive drum exposed by the laser to be brought into opposition to the developing unit 17.

Moreover, before the electrostatic latent image arrives at the transfer position, the record medium can be supplied while it is kept spaced from the photosensitive drum by a distance sufficient to prevent the toner from clinging to the record medium.

In case that the record medium is for example a fanfold paper different from the above embodiment, the fanfold paper is spaced from the photosensitive drum during waiting for data after allowing an intermittent slit line of the fanfold paper to pass by, and the fanfold paper is then moved to a predetermined position relative to the drum when the data output is again generated and a part of the drum corresponding thereto has arrived at the transfer position.

Second embodiment

A second embodiment of the invention will be explained by referring to FIGS. 5a–5c. In this second embodiment, moving means for a record medium is constructed in a different manner and the record medium is a fanfold paper. However, the moving means is of course able to drive record mediums other than the fanfold paper.

Explanation of device

Figure 5A:
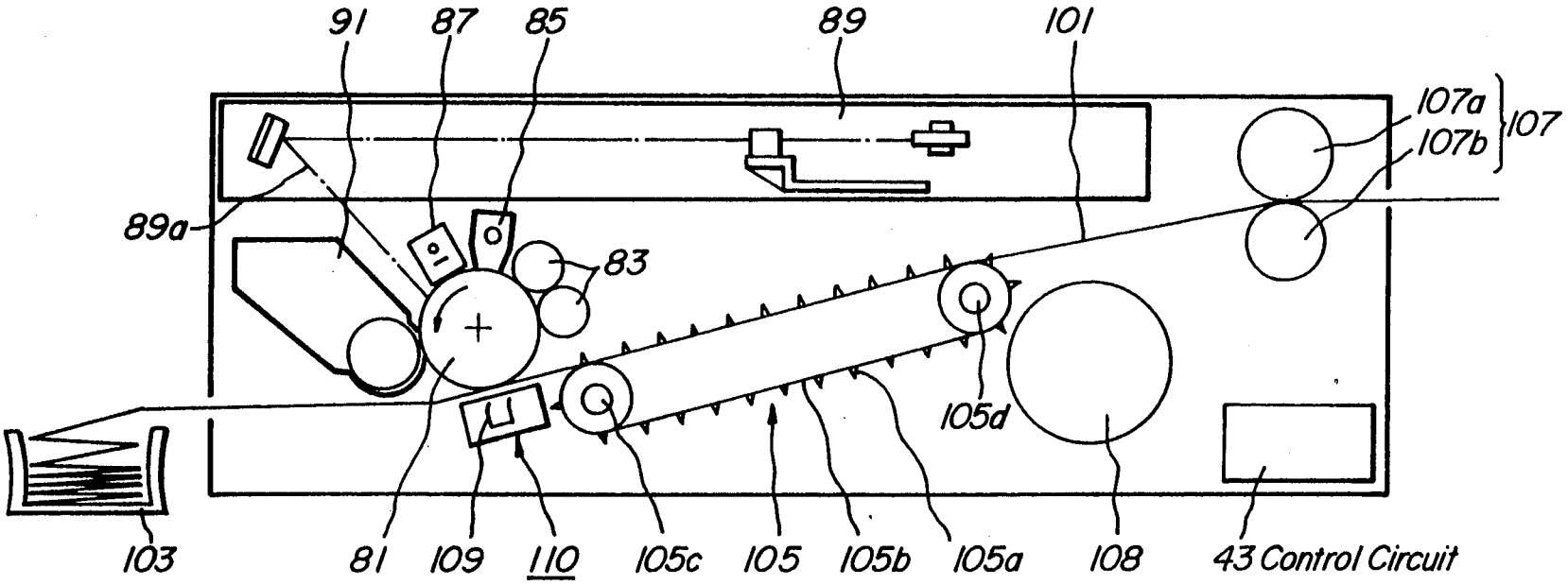
FIGS. 5*a*–5*e* are schematic views illustrating an electrophotograph output device suitable for carrying out a second embodiment of the electrophotograph record medium supply method according to the invention.

FIG. 5a is a side view schematically illustrating one example of a laser beam printer adapted to be able to use a fanfold paper, viewed in a direction in parallel with a rotating axis of a photosensitive drum provided in the printer.

This printer comprises a photosensitive drum 81 rotatable in a predetermined direction shown by an arrow in the drawing. The printer further comprises in series a cleaning unit 83 for removing the toner from the photosensitive drum 81, a discharge unit 85 for causing the drum 81 to discharge, an electric charger 87 for charging the photosensitive drum 81, a laser unit 89 for generating laser beams 89a scanning a surface of the photosensitive drum 81 along directions in parallel with its rotating axis, and a developing unit 91. These members are progressively arranged about the photosensitive drum 81 along the rotating direction thereof.

Moreover, a fanfold paper 101 is supplied at a location in opposition to and spaced by a suitable distance from the drum 81 downstream of the developing unit 91 in the rotating direction of the drum 81. A main body of the fanfold paper is housed in for example a casing 103. The fanfold paper 101 fed from the casing 103 is brought into opposition to the photosensitive drum 81 and passes through a fanfold paper feeding mechanism 105 and arrives at a setting portion 107 under a continuous condition.

In this embodiment, the paper feeding mechanism 105 comprises an endless belt 105b having pawls 105a adapted to engage apertures formed in both edges of the fanfold paper with a predetermined pitch in longitudinal direction of the paper, and two rotary shafts 105c and 105d supporting and rotatively driving the endless belt 105b. The setting portion 107 comprises two rollers 107a and 107b whose outer circumstances are opposed to each other. When the fanfold paper passes through between the two rollers, the fanfold paper is pressed by a predetermined pressure.

In this embodiment, moreover, a motor 108 drives the photosensitive drum 81 and the rollers 107a and 107b of the setting portion 107.

The printer further comprises fanfold paper moving means 110 having a transfer charger 109 arranged on an opposite side of the drum 81 with respect to the fanfold paper 101 at a location where the fanfold paper 101 is in opposition to the drum. This printer also comprises a control circuit 43 as explained by referring to FIG. 2a.

The fanfold paper moving means 110 is constructed as explained hereinafter. FIG. 5b and 5c are side views illustrating, partially in cross section, the fanfold paper moving means 110 shown in FIG. 5a. Further, FIGS. 5d and 5e are perspective views schematically showing positional relation between the fanfold paper 101 as record medium and a guide member (hereinafter be explained) for the fanfold paper.

Figure 5B:
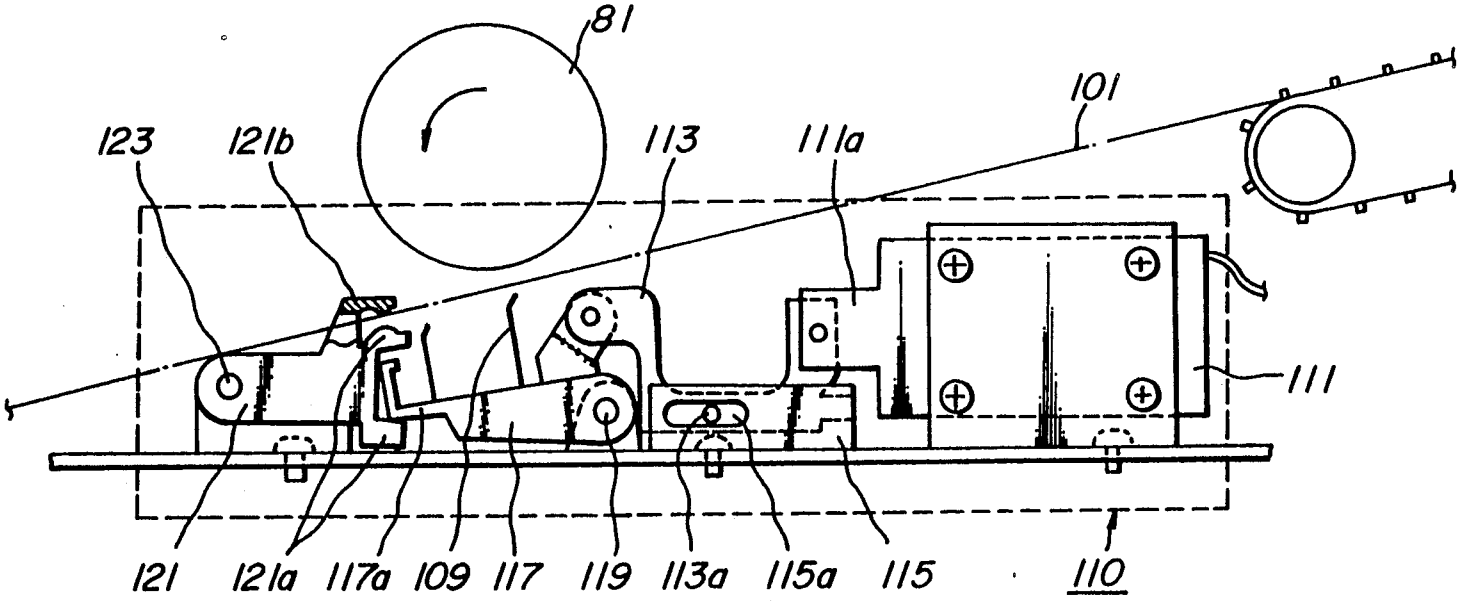
Figure 5C:
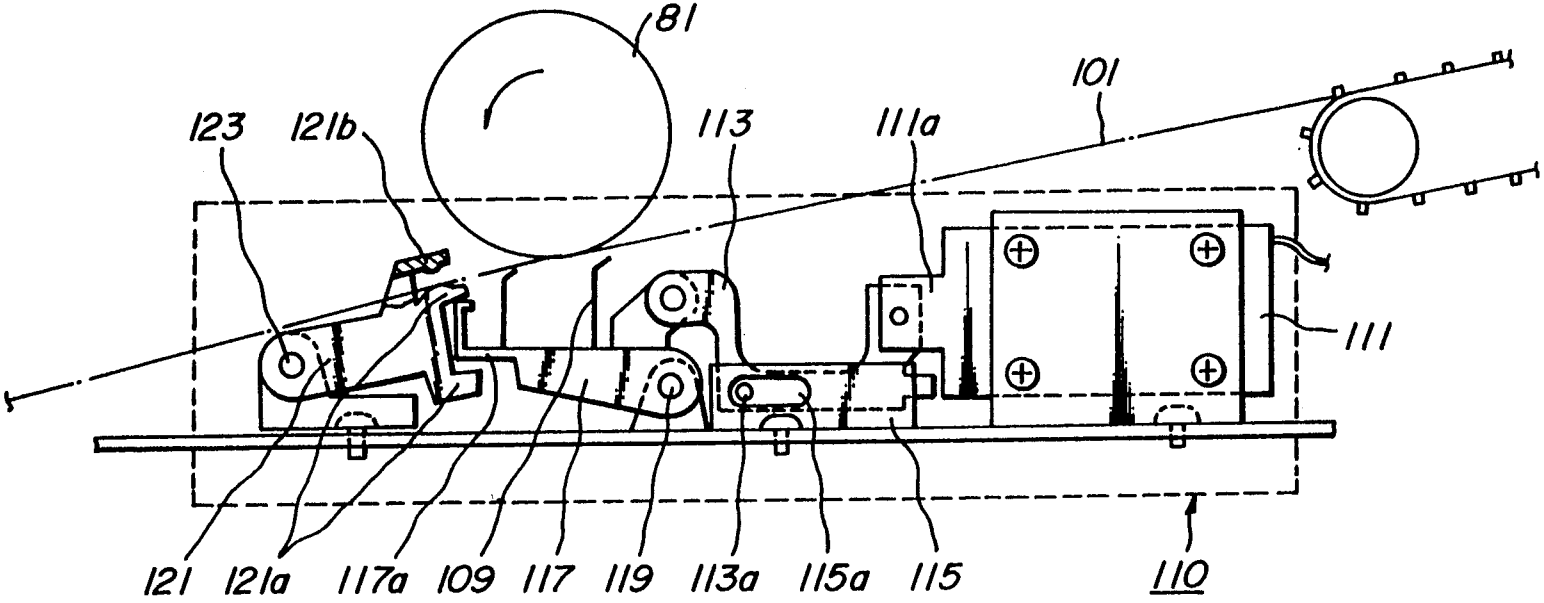
Figure 5D:
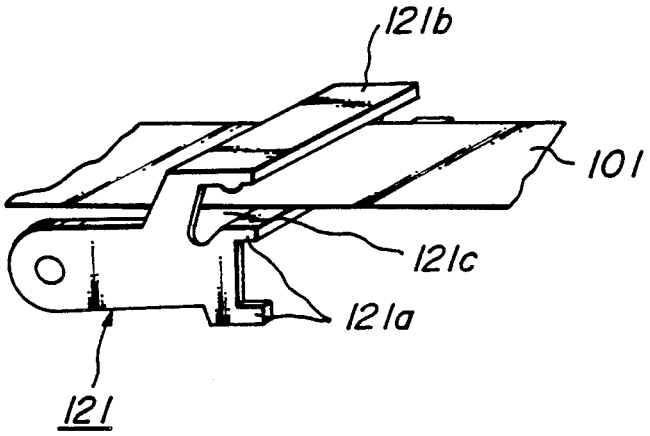
Figure 5E:
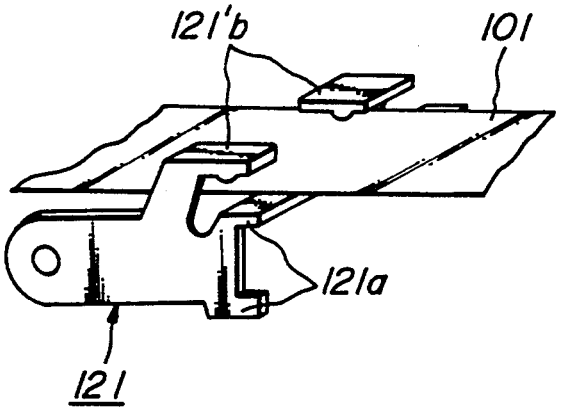

Referring to FIGS. 5b and 5c, the means 110 comprises a solenoid 111 whose plunger 111a having a coupling member 113 connected thereto. The coupling member 113 is provided with a pin 113a and is connected to the plunger 111a so that the pin 113a is slidably fitted in a guide grove 115a of a guide member 115 fixed to a main body of the printer. Reference numeral 117 denotes a movable member provided with the transfer charger 109. The movable member 117 is jointed at its one part to hinge means 119 and connected at the other part to the coupling member 113 so that the movable member 117 is pivotally moved about the hinge means 119 linked with the movement of the plunger 111a of the solenoid 111. The transfer charger 109 is secured at the mid portion of the pivotally movable portion of the movable member 117. A distal end of the pivotally movable portion is substantially L-shaped (as shown by 117a).

Reference numeral 121 illustrates a guide member for the record medium. In this embodiment, the guide member 121 is connected at one end to hinge means 123 so as to be pivotable thereabout. On the other hand, a distal end of the guide member 121 is formed with a pawl 121b for loosely embracing the record medium and with a groove shaped portion 121a adapted to be engaged with the L-shaped portion of the distal end of the movable member 117 and anchored thereby. With this arrangement, the record medium, for example, fanfold paper 101 is fed through a slit portion 121c formed by the portions 121a and 121b as shown in FIG. 5d and is brought into opposition to the photosensitive drum 81. Thereafter, the fanfold paper is introduced into the setting portion 107. In the example shown in FIG. 5d, the portion 121b is constructed so as to cross over above the fanfold paper 101 in a direction perpendicular to the moving direction thereof. However, as shown in FIG. 5e, the guide member 121 may be so constructed that two pawls 121'b, 121'b are separately opposed to each other and protrude into the partial zones above the fanfold paper 101 from both edge sides thereof, respectively.

Record medium supply method

Supplying a fanfold paper by the use of the device is explained by referring to FIGS. 5a–5c.

As the photosensitive drum 81 is rotated, cleaning and discharging of part of the drum 81 are effected. Then the part of the drum 81 cleaned and discharged charges at a voltage of between −400 and −500 V with the aid of the electric charger 87. Thereafter, laser beams 89a are selectively irradiated against the photosensitive drum 81 according to image data so that electrostatic latent images associated with images are formed on the photosensitive drum. The electrostatic latent images are converted to sensible images by means of toner supplied from the developing unit 91.

The images converted into the sensible images by means of the developing unit 91 are fed to the position in opposition to the fanfold paper as the photosensitive drum 81 is rotated. The toner on the images are transferred onto a transfer zone of the fanfold paper by means of the transfer charger 109 provided on a back side of the fanfold paper 101.

In the printer of the second embodiment, the fanfold paper 101 is moved toward and away from the photosensitive drum 81 in a manner as described hereinafter.

When any signal is not supplied from the control circuit 43 to the solenoid 111, the record medium guide member 121 of the moving means 110 and the transfer charger 109 lower in vertical directions by gravity or move away from the photosensitive drum as shown in FIG. 5*b*. As a result, the record medium is moved away from the photosensitive drum 81 by a distance not permitting the toner to cling to the record medium.

On the other hand, when a signal is supplied from the control circuit 43 to the solenoid 111, the solenoid 111 is excited to attract the plunger 111*a* to the solenoid, as shown in FIG. 5*c*. As a result, the coupling member 113 is moved away from the photosensitive drum so that the pivotable end of the movable member 117 is moved toward the photosensitive drum, with the result that the transfer charger 109 approaches a predetermined position relative to the photosensitive drum 81. At this time, the groove shaped portion 121*a* of the record medium guide member 121 is raised toward the drum 81 by the L-shaped portion 117*a* of the movable member 117. As a result, the record medium is brought toward the drum into a position suitable for forming images.

With the device shown in FIGS. 5*a*–5*c*, therefore, the record medium can be spaced from the photosensitive drum by the distance sufficient to prohibit the toner from clinging to the record medium as shown in FIG. 5*b* until the electrostatic latent images on the drum arrive at the transfer position. Therefore, the fanfold paper can be spaced from the photosensitive drum even during stoppage of the fanfold paper awaiting data after allowing an intermittent line of the fanfold paper to pass by. Therefore, wear of the photosensitive drum can be prevented. Moreover, the zone of the record medium on which the toner has been transferred is then fed to the settling portion 107 by means of the paper feeding mechanism 105. The toner clung to the record medium is collapsed between the rollers 107*a* and 107*b* of the settling portion so that the toner is settled on the record medium to form images.

Modification

Figure 6:
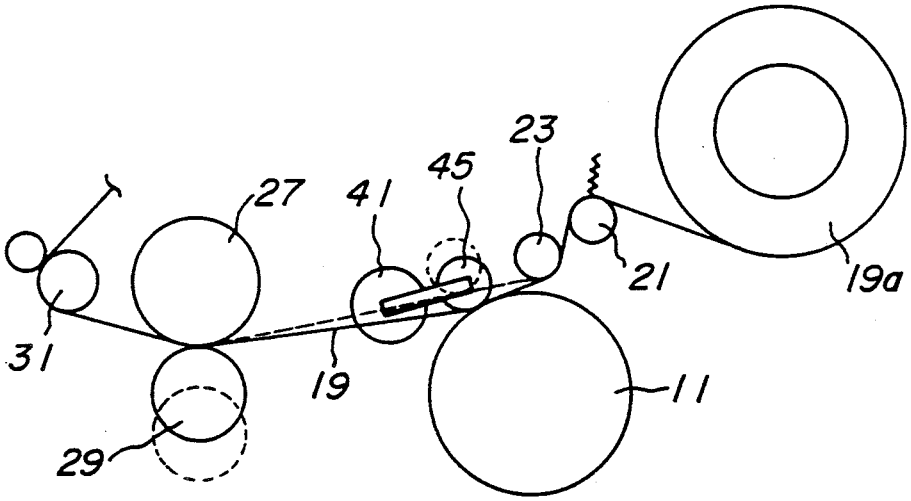
FIG. 6 is a schematic view showing a modification of the electrophotograph output device shown in FIGS. 5*a*–5*c*.

FIG. 6 illustrates a modification of the printer to which the supply method according to the invention is preferably applicable. FIG. 6 shows only parts which correspond to partial components in FIG. 2*a* and are essential for explaining the modification. In this embodiment, a transfer rubber roller 45 is used instead of the transfer charger 109 of the printer explained by referring to FIG. 2*a*. In this case, it is possible to change the position of the transfer rubber roller 45 relative to a photosensitive drum 11 by directly moving the transfer rubber roller 45 upward and downward by means of a rotary solenoid 41, thereby obtaining the effect substantially the same as that above described.

Moreover, the invention is not limited to the above embodiments and various changes may be made as described hereinafter.

In the above embodiments, the time from the start of rotating the photosensitive drum 11 to the arrival of the electrostatic latent images at the transfer position is determined by the predetermined reference time. In case that the photosensitive drum is driven by pulse motor, however, the rotation of the photosensitive drum can be controlled by counting the number of pulses of the pulse motor. Therefore, the rotation of the photosensitive drum from the laser irradiation position to the transfer position may be controlled by the number of pulses generated by the pulse motor. The time setting can be effected in this manner. By using results of this, the timing of feeding the photosensitive drum and change in distance between the record medium and the photosensitive drum may be controlled.

In the above embodiment, moreover, at the moment when the first electrostatic latent images have arrived at the transfer position, the leading end of a transfer zone of a record medium arrives at the transfer position, and the record medium is kept spaced from the photosensitive drum by the distance sufficient to prohibit the toner from clinging to the record medium until the first electrostatic latent images arrive at the transfer position. A superfluous consumption of the record medium can be reduced in this manner. However, only either one of the two may reduce the consumption of the record medium. This holds true for example in case that the record medium is a single paper. In case of the single paper the record medium can be advantageously used with a construction in that at a moment when the first electrostatic latent images have arrived at the transfer position, a leading end of a transfer zone of the single record medium arrives at the transfer position.

As can be seen from the above explanation, in the first aspect of the invention, only the photosensitive drum is first rotated and the respective operations of the charging, the forming of electrostatic latent images, and the developing of the images are then effected, so that the record medium can be supplied around the time when sensible ones of electrostatic latent images arrive at the transfer position. Therefore, the record medium can be supplied without superfluous consumption of the record medium.

In the second aspect of the invention, moreover, immediately after the start of forming images or after the period for awaiting data after allowing an intermittent slit line to pass by, the record medium is spaced from the photosensitive drum by the distance sufficient to prevent the toner from clinging to the record medium, while part of the photosensitive drum which has not been charged is in opposition to the record medium. Therefore, the record medium can be supplied in a manner preventing the wear of the photosensitive drum due to friction with the record medium without any superfluous consumption of the record medium.

While the invention has been particularly shown and described with reference to preferred embodiments thereof, it will be understood by those skilled in the art that the foregoing and other changes in details can be made therein without departing from the spirit and scope of the invention.

What is claimed is:

1. An apparatus for supplying continuous paper to a printer including a photosensitive means, an electric charger, an electrostatic latent image forming means, a developing unit and a transfer charger which are arranged in succession along a moving direction of said photosensitive means, comprising:

means for supplying said continuous paper between said transfer charger and said photosensitive medium; and a continuous paper supply control circuit that includes a first reference time signal output circuit and a second reference time signal output circuit, said first reference time signal output circuit initiating a count operation upon the receipt of a start signal for moving said photosensitive mean, a first output signal being generated by said first reference time signal output circuit after a given time has passed from the initiation of said count operation, said second reference time signal output circuit initiating said count operation upon the receipt of said start signal for moving said photosensitive means, said second reference time signal output circuit generating a second output signal after a predetermined time which is longer than the time that passes from the initiation of said count operation, said first output signal being used as a first starting signal for operating said electrostatic latent image forming means and said developing unit, said second output signal being used as a second starting signal for operating said transfer charger and said continuous paper, wherein each of said first and second reference time signal output circuit comprises a timer standard integrated circuit for initiating said count operation and generating an output signal, a reference value setting circuit for setting said given time in each of said first and second reference time signal output circuits, and a D type flip-flop circuit for supplying said first or second output signal in response to said output signal.

2. An apparatus as set forth in claim 11, wherein the photosensitive means comprises a rotary photosensitive drum.

3. An apparatus for supplying continuous paper to a printer including a photosensitive means, an electric charger, an electrostatic latent image forming means, a developing unit and a transfer charger which are arranged in succession along a moving direction of said photosensitive means, comprising:

means for supplying said continuous paper between said transfer charger and said photosensitive medium; and a continuous paper supply control circuit that includes a first reference time signal output circuit, a second reference time signal output circuit, and AND gate which generates an AND output signal to start the rotation of said photosensitive means, a pulse signal for driving said photosensitive means, and a D type flip-flop which generates an output signal for starting operations of said first and second reference time signal output circuits in response to said output signal from said AND gate, said first reference time signal output circuit initiating a count operation upon the receipt of a start signal for moving said photosensitive means, a first output signal being generated by said first reference time signal output circuit after a given time has passed from the initiation of said count operation, said second reference time signal output circuit initiating said count operation upon the receipt of said start signal for moving said photosensitive means, said second reference time signal output circuit generating a second output signal after a predetermined time which is longer than the time that passes from the initiation of said count operation, said first output signal being used as a first starting signal for operating said electrostatic latent image forming means and said developing unit, said second output signal being used as a second starting signal for operating said transfer charger and said continuous paper.

4. A method of supplying continuous paper to a printer, comprising the steps of:

forming electrostatic latent images on a photosensitive means;

converting the latent images on the photosensitive means to sensible images by applying toner to the photosensitive means;

supplying the continuous paper between a transfer charger and the photosensitive means;

initiating a first reference time signal count operation in response to a start signal to rotate the photosensitive means;

generating a first output signal for operating a developing unit after a predetermined period of time passes from the initiation of the count operation;

initiating a second reference time signal count operation upon receipt of the start signal to rotate the photosensitive means; and generating a second output signal that is longer than the time that passes from the initiation of the second reference time signal count operation;

controlling the supply of the continuous paper in response to the first reference time signal count operation and second reference time signal count operation;

moving the continuous paper towards and away from the photosensitive means in response to the second output signal with a guide member that is formed with at least one pawl portion for loosely embracing the continuous paper and a groove shaped portion so as to form a slit therebetween through which slit the continuous paper is fed so as to be brought into opposition to the photosensitive means; and transferring the sensible images to the continuous paper at a transfer position where the sensible images are in opposition with a printable zone of the continuous paper so as to form printed images, a predetermined time period existing from when the photosensitive means starts moving to the moment when the sensible images have arrived at the transfer position.

5. A method as set forth in claim 4, wherein the step of moving the continuous paper comprises moving the continuous paper towards and away from said photosensitive means by a paper feeding roller that is driven by a rotating arm of a rotary solenoid so as to bring the continuous paper into and out of contact with the photosensitive means in response to signals sent to the rotary solenoid from a control circuit which controls the timing of the feeding of the continuous paper.

6. A method as set forth in claim 4, wherein the step of moving the continuous paper comprises moving the continuous paper towards and away from the photosensitive means by a guide member that is driven by a solenoid through a coupling member and a movable member so as to be brought into and out of contact with the photosensitive means in response to signals sent to the solenoid from a control circuit which controls the timing of the feeding of the continuous paper.

7. A method as set forth in claim 6, wherein the step of moving the continuous paper comprises embracing the continuous paper with the guide member when a signal is not supplied to the solenoid, the guide member lowering in a vertical direction by the force of gravity to move the continuous paper away from the photosensitive means.

8. A method as set forth in claim 4, further comprising the step of controlling the rotation of the photosensitive means by obtaining timing information of the rotation of the photosensitive means, the results of the timing information controlling the supplying of the continuous paper and the continuous paper's change in distance between the photosensitive means and the continuous paper.

9. A method as set forth in claim 4, wherein the step of forming electrostatic latent images on the photosensitive means comprises forming an electrostatic latent image on a rotary photosensitive drum.

10. An apparatus for supplying continuous paper to a printer including a photosensitive means, an electric charger, an electrostatic latent image forming means, a developing unit and a transfer charger which are arranged in succession along a moving direction of said photosensitive means, comprising:

means for supplying said continuous paper between said transfer charger and said photosensitive medium;

a continuous paper supply control circuit that includes a first reference time signal output circuit and a second reference time signal output circuit, said first reference time signal output circuit initiating a count operation upon the receipt of a start signal for moving said photosensitive means, a first output signal being generated by said first reference time signal output circuit after a given time has passed from the initiation of said count operation, said second reference time signal output circuit initiating said count operation upon the receipt of said start signal for moving said photosensitive means, said second reference time signal output circuit generating a second output signal after a predetermined time which is longer than the time that passes from the initiation of said count operation, said first output signal being used as a first starting signal for operating said electrostatic latent image forming means and said developing unit, said second output signal being used as a second starting signal for operating said transfer charger and said continuous paper; and means for moving said continuous paper towards and away from said photosensitive means in response to said second output signal, said continuous paper moving means comprising a guide member having a slit therein through which said continuous paper is fed so as to be brought into opposition to said photosensitive means.

11. An apparatus as set forth in claim 10, wherein the photosensitive means comprises a rotary photosensitive drum.

12. An apparatus as set forth in claim 10, said continuous paper supply control circuit further comprising an AND gate which generates an AND output signal to start the rotation of said photosensitive means and a pulse signal for driving said photosensitive means, and a D type flip-flop which generates an output signal for starting operations of said first and second reference time signal output circuits in response to said output signal from said AND gate.

13. An apparatus for supplying a record medium to a printer including a photosensitive means, an electric charger, an electrostatic latent image forming means, a developing unit and a transfer charger which are arranged in succession along a moving direction of said photosensitive means, comprising:

means for supplying said record medium between said transfer charger and said photosensitive medium;

continuous paper supply control circuit that includes a first reference time signal output circuit and a second reference time signal output circuit, said first reference time signal output circuit initiating a count operation upon the receipt of a start signal for rotating said photosensitive means, said first reference time signal output circuit generating a first output signal after a given time passes from the initiation of said count operation, said first output signal being used as a signal for operating said developing unit, said second reference time signal output circuit initiating said count operation upon receipt of said start signal for moving said photosensitive means, said second reference time output circuit generating a second output signal after a predetermined time which is longer than the time that passes from the initiation of said count operation; and means for moving said record medium towards and away from said photosensitive means in response to said second output signal, said record medium moving means comprising a guide member, said guide member being formed with at least one pawl portion for loosely embracing said record medium and a groove shaped portion so as to form a slit therebetween through which said record medium is fed so as to be brought into opposition to said photosensitive means.

14. An apparatus as set forth in claim 13, wherein each of said first and second reference time signal output circuit comprises a timer standard integrated circuit for initiating said count operation and generating an output signal, a reference value setting circuit for setting said given time in each of said first and second reference time signal output circuits, and a D type flip-flop circuit for supplying said first or second output signal in response to said output signal.

15. An apparatus as set forth in claim 14, wherein the photosensitive means comprises a rotary photosensitive drum.

16. An apparatus as set forth in claim 13, wherein the photosensitive means comprises a rotary photosensitive drum.

17. An apparatus as set forth in claim 13, wherein said continuous paper moving means comprises a rotary solenoid having a rotating arm connected to a paper feeding roller.

18. An apparatus for supplying continuous paper to a printer including a photosensitive means, an electric charger, an electrostatic latent image forming means, a developing unit and a transfer charger which are arranged in succession along a moving direction of said photosensitive means, comprising:

means for supplying said continuous paper between said transfer charger and said photosensitive medium;

continuous paper supply control circuit that includes a first reference time signal output circuit and a second reference time signal output circuit, said first reference time signal output circuit initiating a count operation upon the receipt of a start signal for rotating said photosensitive means, said first reference time signal output circuit generating a first output signal after a given time passes from the initiation of said count operation, said first output signal being used as a signal for operating said developing unit, said second reference time signal output circuit initiating said count operation upon receipt of said start signal for moving said photosensitive means, said second reference time output circuit generating a second output signal after a predetermined time which is longer than the time that passes from the initiation of said count operation; and means for moving said continuous paper toward and away from said photosensitive means in response to said second output signal, wherein each of said first and second reference time signal output circuit comprises a timer standard integrated circuit for initiating said count operation and generating an output signal, a reference value setting circuit for setting said given time in each of said first and second reference time signal output circuits, and a D type flip-flop circuit for supplying said first or second output signal in response to said output signal.

19. An apparatus for supplying continuous paper to a printer having photosensitive means, an electric charger, means for forming an electrostatic latent image, a developing unit and a transfer charger which are arranged in succession along a moving direction of said photosensitive means, comprising:

means for supplying said continuous paper between said transfer charger and said photosensitive medium;

first means for moving said continuous paper towards and away from said photosensitive means, said first moving means comprising a guide member that is driven by a solenoid through a coupling member and a movable member, so as to be brought into and out of contact with said photosensitive means in response to signals sent to said solenoid from a control circuit which controls a timing of a feeding of said continuous paper, said guide member having a slit portion for loosely embracing said continuous paper when a signal is not supplied to said solenoid, said guide member lowering in a vertical direction by a force of gravity to move said continuous paper away from said photosensitive means; and second means for moving said transfer charger towards and away from said photosensitive means, said first moving means being driven simultaneous to the operation of said second moving means.

20. The apparatus of claim 19, wherein said second moving means comprises a movable member that is jointed proximate one end to a hinge means and connected at the other end to a coupling member so that said movable member is pivotally moved about said hinge means which is linked with a movement of a plunger of a solenoid.

* * * * *